US011092403B2

(12) United States Patent
Ray

(10) Patent No.: US 11,092,403 B2
(45) Date of Patent: Aug. 17, 2021

(54) BUFFER TUBE MOUNT

(71) Applicant: James Mitchell Ray, Willis, TX (US)

(72) Inventor: James Mitchell Ray, Willis, TX (US)

( * ) Notice: Subject to any disclaimer, the term of this patent is extended or adjusted under 35 U.S.C. 154(b) by 0 days.

(21) Appl. No.: 15/863,852

(22) Filed: Jan. 5, 2018

(65) Prior Publication Data

US 2018/0187990 A1 Jul. 5, 2018

Related U.S. Application Data

(60) Provisional application No. 62/442,913, filed on Jan. 5, 2017.

(51) Int. Cl.

| | |
|---|---|
| ***F41C 23/02*** | (2006.01) |
| ***F41A 11/00*** | (2006.01) |
| ***F41C 33/00*** | (2006.01) |
| ***F41C 23/12*** | (2006.01) |
| ***F41C 23/20*** | (2006.01) |
| ***F41C 33/02*** | (2006.01) |
| *F41A 3/66* | (2006.01) |
| *F41A 3/78* | (2006.01) |

(52) U.S. Cl.

CPC ..... *F41C 23/02* (2013.01); *F41A 11/00* (2013.01); *F41C 23/12* (2013.01); *F41C 23/20* (2013.01); *F41C 33/007* (2013.01); *F41C 33/0245* (2013.01); *F41A 3/66* (2013.01); *F41A 3/78* (2013.01)

(58) Field of Classification Search

CPC ..... F41C 23/02; F41C 27/00; F41C 33/002; F41C 33/006; F41C 33/007

See application file for complete search history.

(56) References Cited

U.S. PATENT DOCUMENTS

| | | | | | |
|---|---|---|---|---|---|
| D556,850 | S | * | 12/2007 | Kincel | F41C 23/02 D22/108 |
| D568,957 | S | * | 5/2008 | Esch | D22/108 |
| 8,166,694 | B2 | | 5/2012 | Swan | |
| 8,596,504 | B2 | * | 12/2013 | Haley, Sr. | F41C 33/002 224/149 |
| D724,484 | S | | 3/2015 | Swan et al. | |
| D731,294 | S | | 6/2015 | Swan et al. | |
| 9,146,074 | B1 | * | 9/2015 | McCarthy | F41C 23/02 |
| D753,256 | S | * | 4/2016 | Azhocar | D22/108 |
| D753,257 | S | * | 4/2016 | Azhocar | D22/108 |
| D813,972 | S | * | 3/2018 | Montes | D22/108 |
| 2005/0034347 | A1 | * | 2/2005 | Verdugo | F41C 23/02 42/85 |
| 2010/0162609 | A1 | * | 7/2010 | Rogers | F41C 23/02 42/85 |
| 2013/0276343 | A1 | * | 10/2013 | Peters | F41C 33/006 42/90 |
| 2015/0327658 | A1 | | 11/2015 | Swan et al. | |

OTHER PUBLICATIONS https://web.archive.org/web/20130906023624/http://www.buttonsling.com, Sep. 6, 2013, Tactical Single Point Sling for AR15, M4, MP5, SHotguns and More! (webarchive pdf).*
http://www.buttonsling.com/Single_Point_Slings/Store.html.

* cited by examiner

*Primary Examiner* — Benjamin P Lee
(74) *Attorney, Agent, or Firm* — Lightfoot & Alford PLLC

(57) ABSTRACT

A firearm support system (FSS) includes a buffer tube mount (BTM) having a first complementary component and a receiver comprising a second complementary component configured to selectively receive the first complementary component. The BTM comprises a shelf that extends from a ring of the BTM.

13 Claims, 12 Drawing Sheets

BUFFER TUBE MOUNT

CROSS-REFERENCE TO RELATED APPLICATIONS

This patent application claims the benefit of the filing date of the U.S. Provisional Patent Application Ser. No. 62/442,913, filed on 5 Jan. 2017 and entitled "Buffer Tube Mount," the entire content of which is hereby expressly incorporated by reference.

STATEMENT REGARDING FEDERALLY SPONSORED RESEARCH OR DEVELOPMENT

Not applicable

REFERENCE TO A MICROFICHE APPENDIX

Not applicable

BACKGROUND

Some firearms comprising buffer tubes, such as, but not limited to, AR-15 type firearms, are carried in an uncomfortable manner.

DETAILED DESCRIPTION

Referring now to FIGS. 1-18, a firearm support system (FSS) 3100 is disclosed as comprising a buffer tube mount (BTM) 3102 and a receiver 3104. The BTM 3102 comprises a first complementary component 3106 and the receiver 3104 comprises a second complementary component 3108 that is configured for selective engagement with the first complementary component 3106. In this embodiment, the first complementary component 3106 comprises a raised button, knuckle, and/or male component generally comprising a rounded head 3210 carried by a central shaft or neck 3208. In this embodiment, the second complementary component 3108 comprises a U-shaped receiver channel configured to allow the central shaft to slide into the U-shaped receiver channel while also being configured to at least partially selectively capture the first complementary component 3106.

Figure 1:
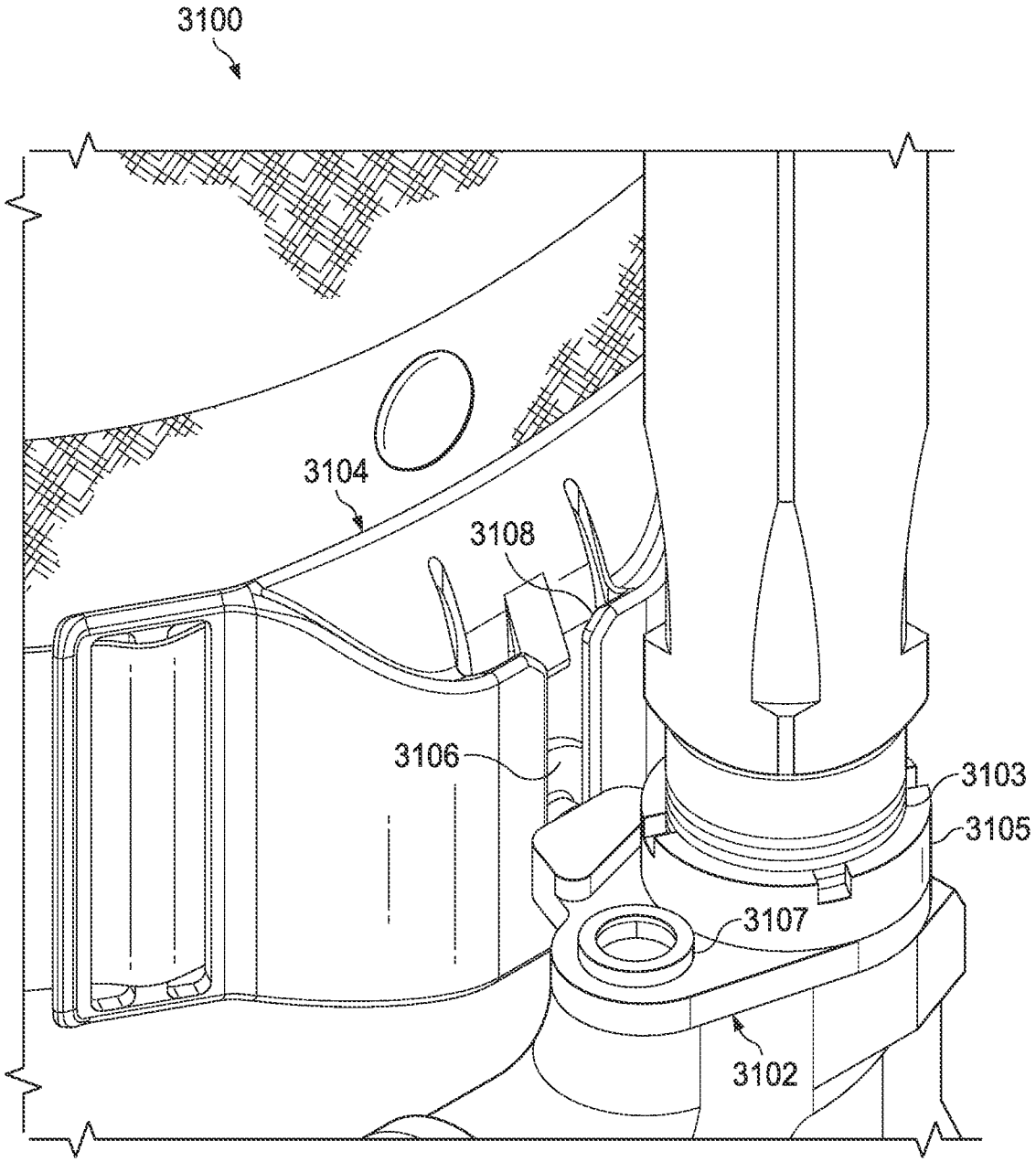
FIG. 1 is an oblique view of a firearm support system according to an embodiment of the disclosure.
Figure 2:
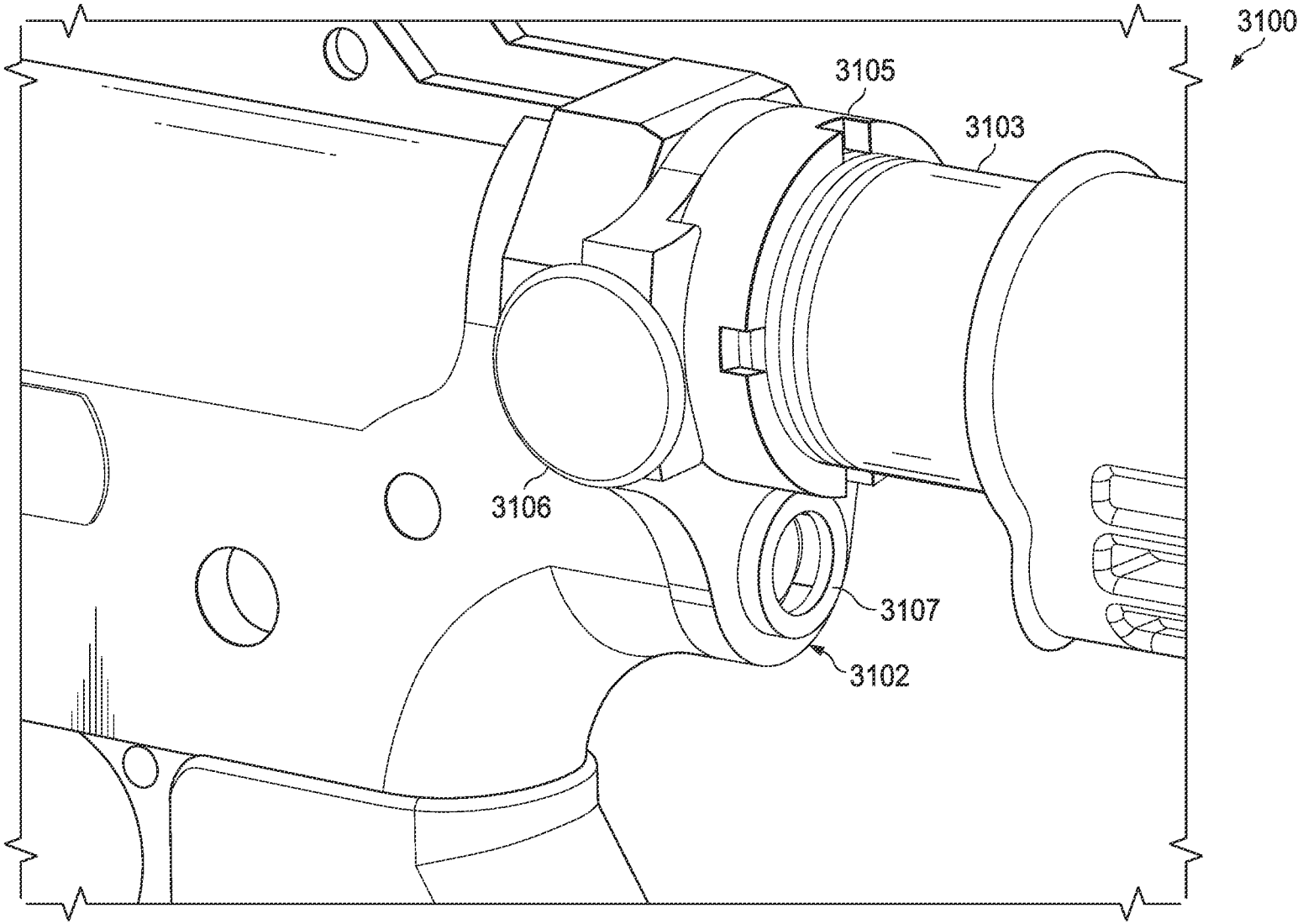
FIG. 2 is an oblique view of a buffer tube mount of the firearm support system of FIG. 1 mounted to a firearm.
Figure 3:
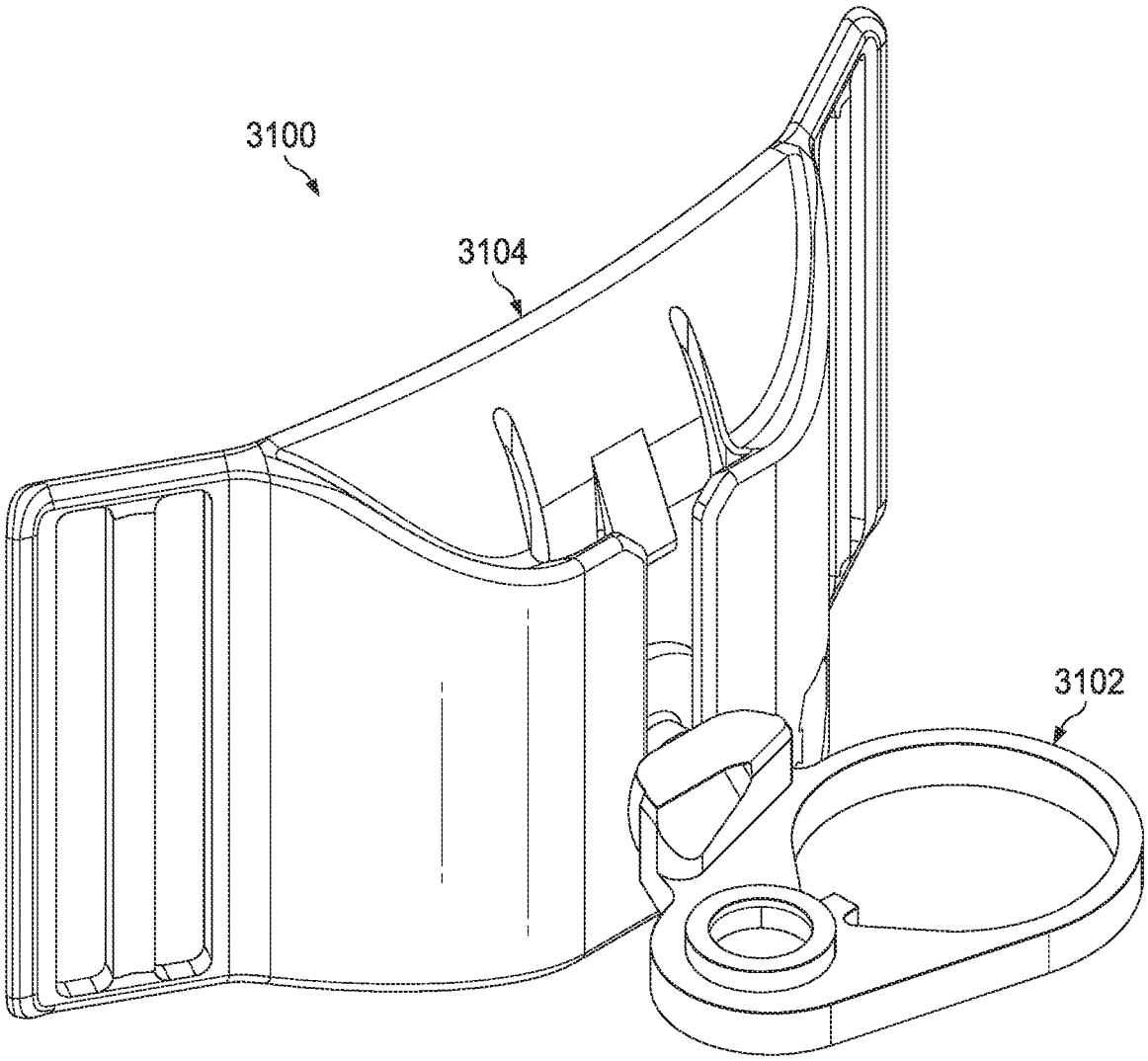
FIG. 3 is an oblique view of the buffer tube mount of the firearm support system of FIG. 1 attached to a receiver unit of the firearm support system of FIG. 1.
Figure 4:
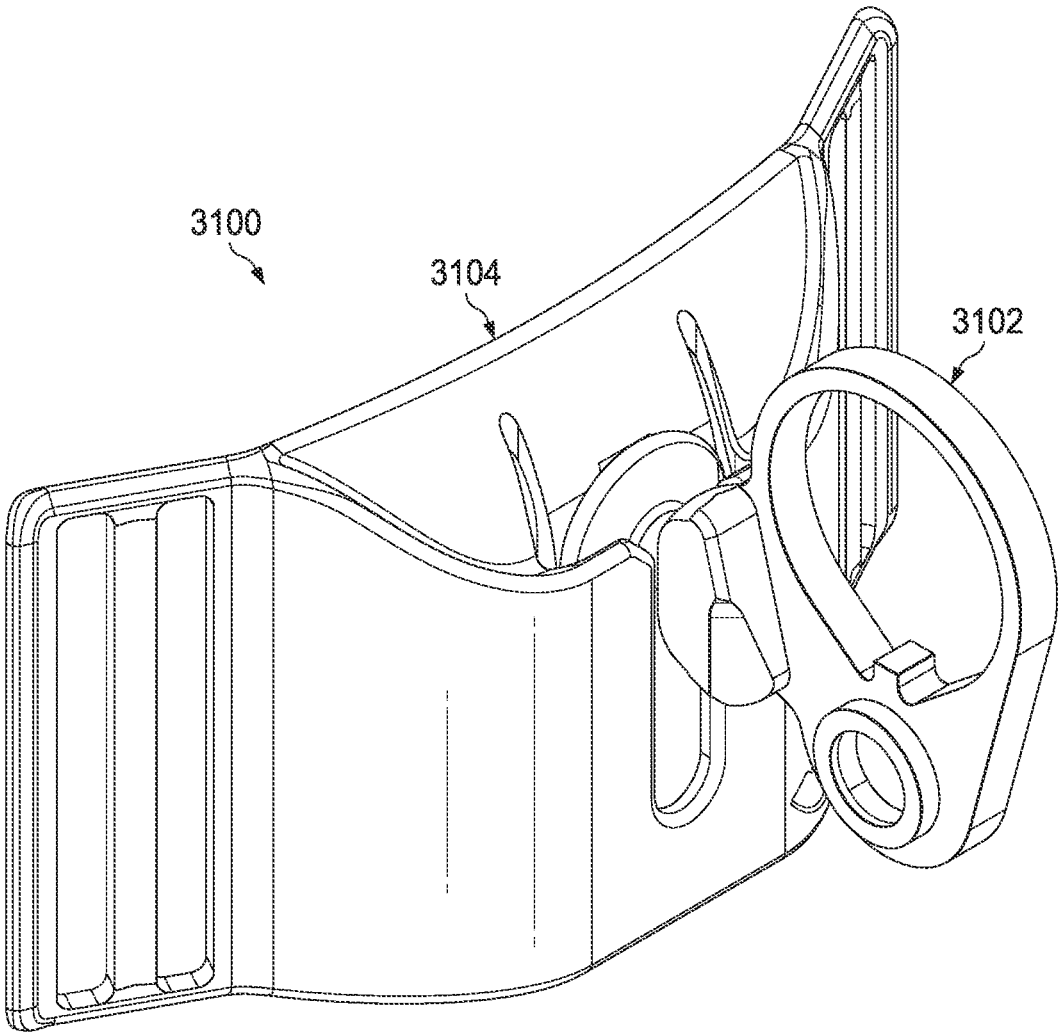
FIG. 4 is another oblique view of the buffer tube mount of the firearm support system of FIG. 1 mounted to the receiver unit of the firearm support system of FIG. 1.
Figure 5:
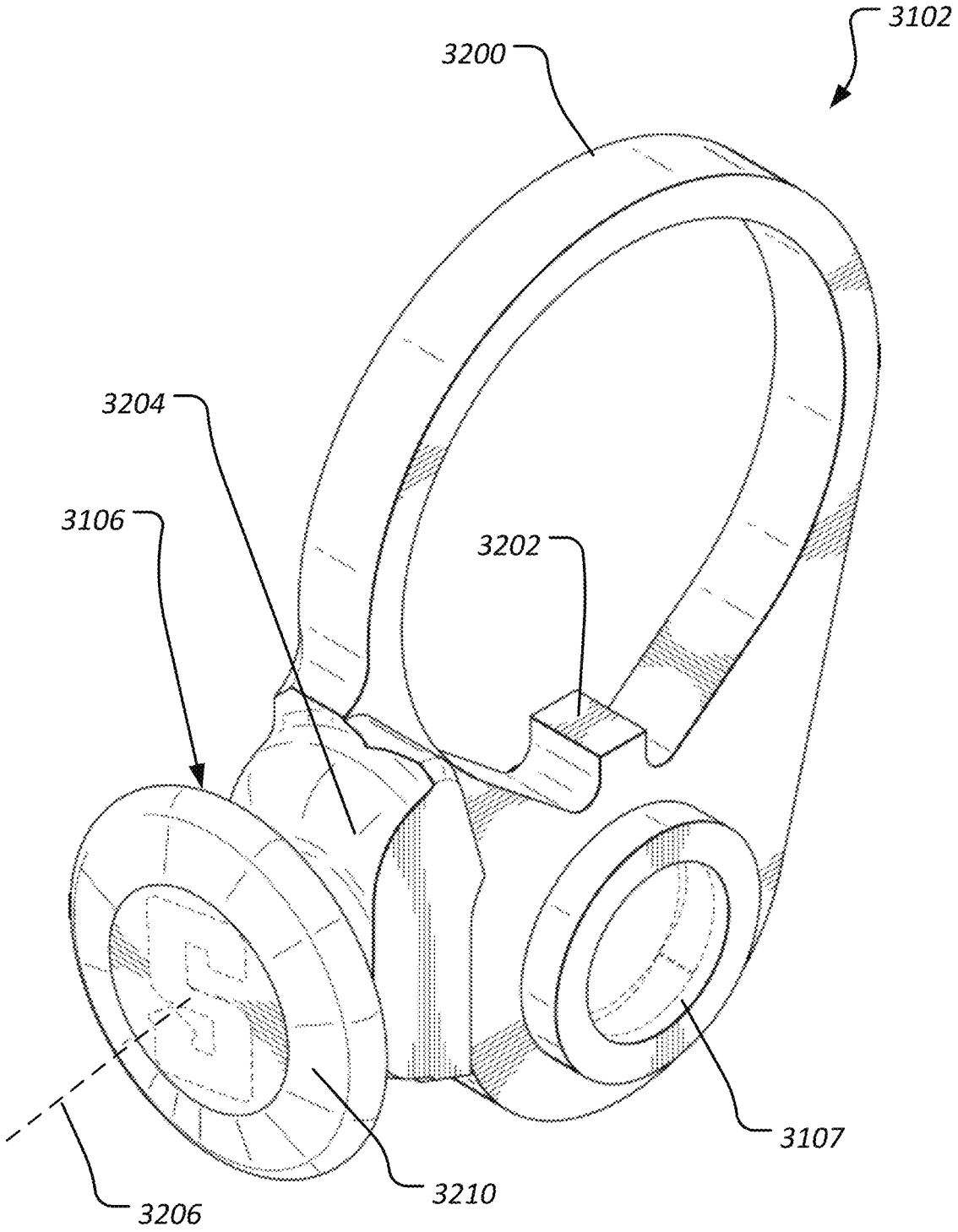
FIG. 5 is an oblique view of the buffer tube mount of FIG. 1.
Figure 6:
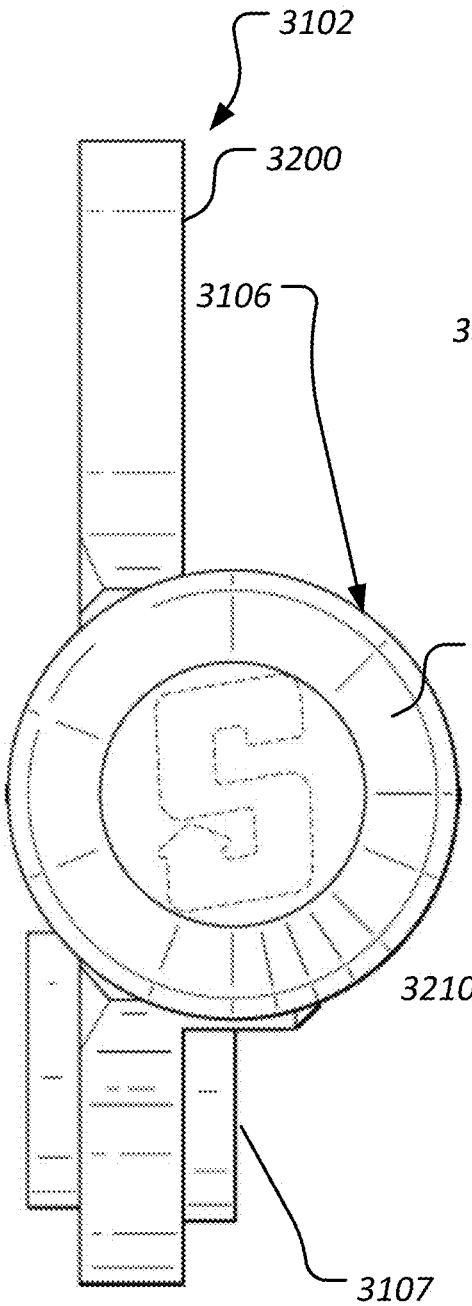
FIG. 6 is an orthogonal rear view of the buffer tube mount of FIG. 1.
Figure 7:
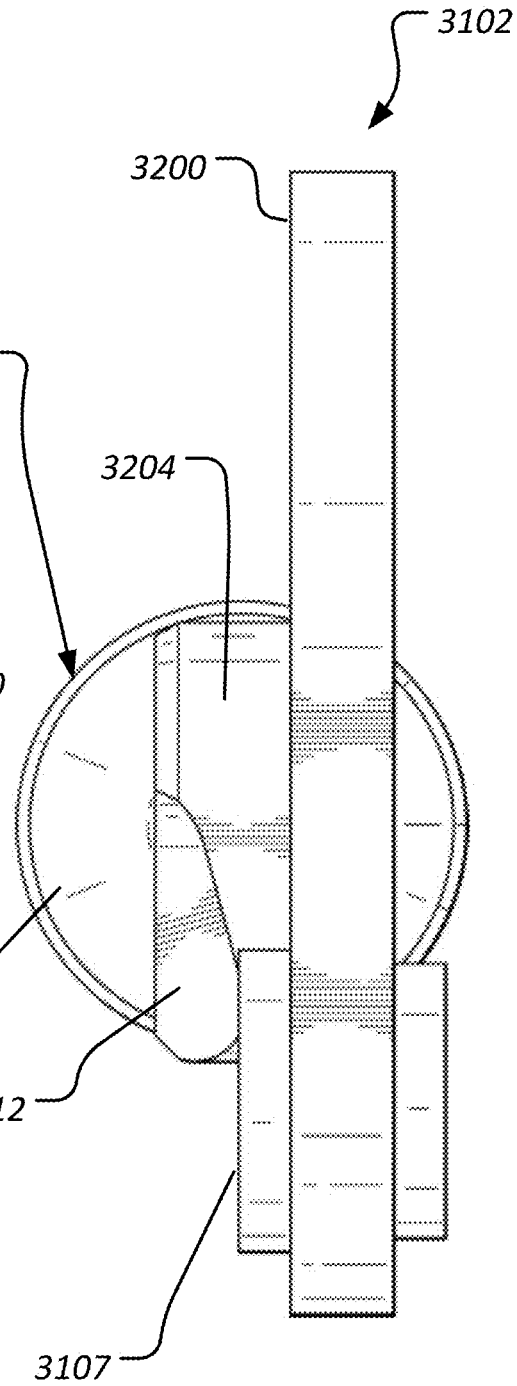
FIG. 7 is an orthogonal front view of the buffer tube mount of FIG. 1.
Figure 8:
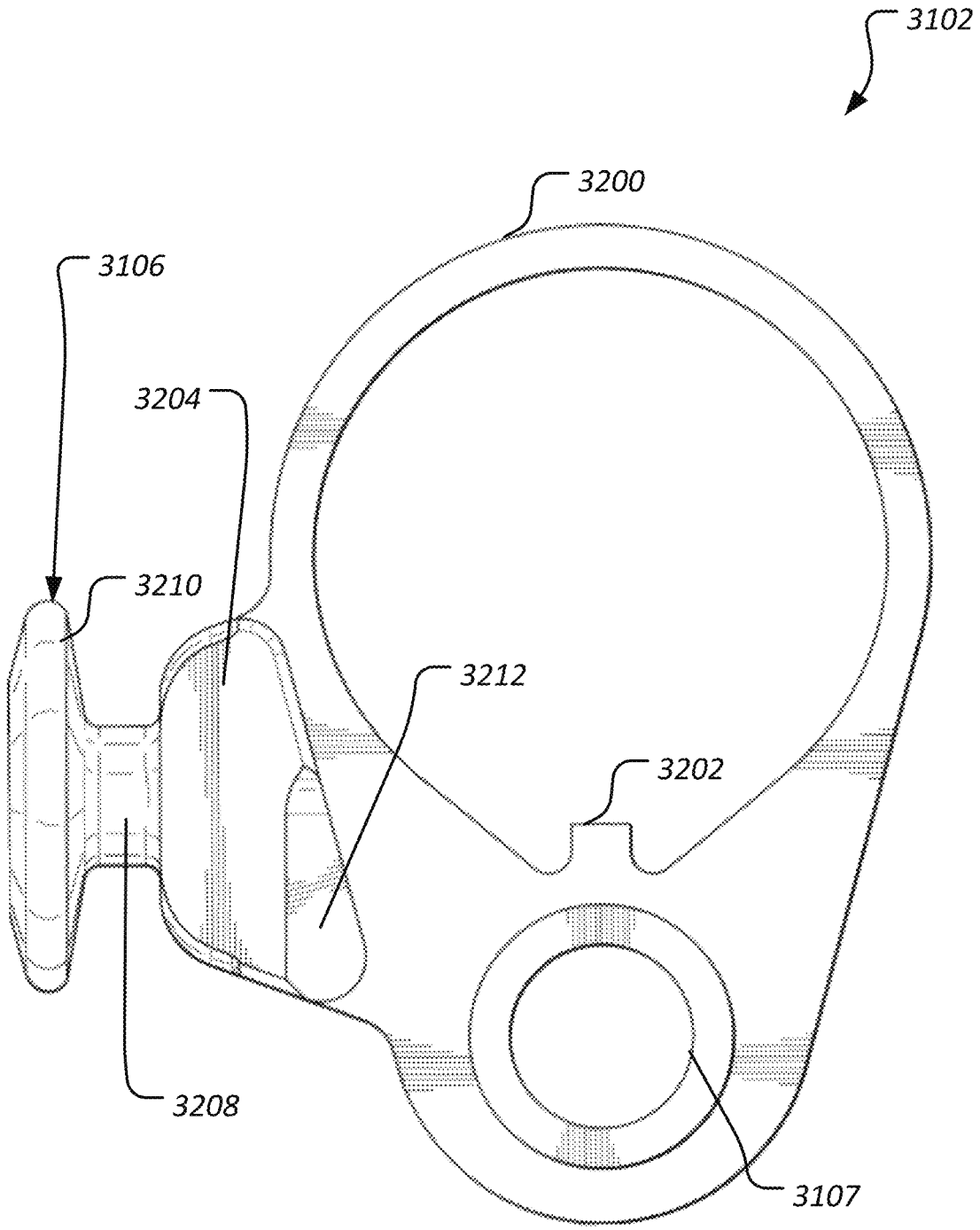
FIG. 8 is an orthogonal left view of the buffer tube mount of FIG. 1.
Figure 9:
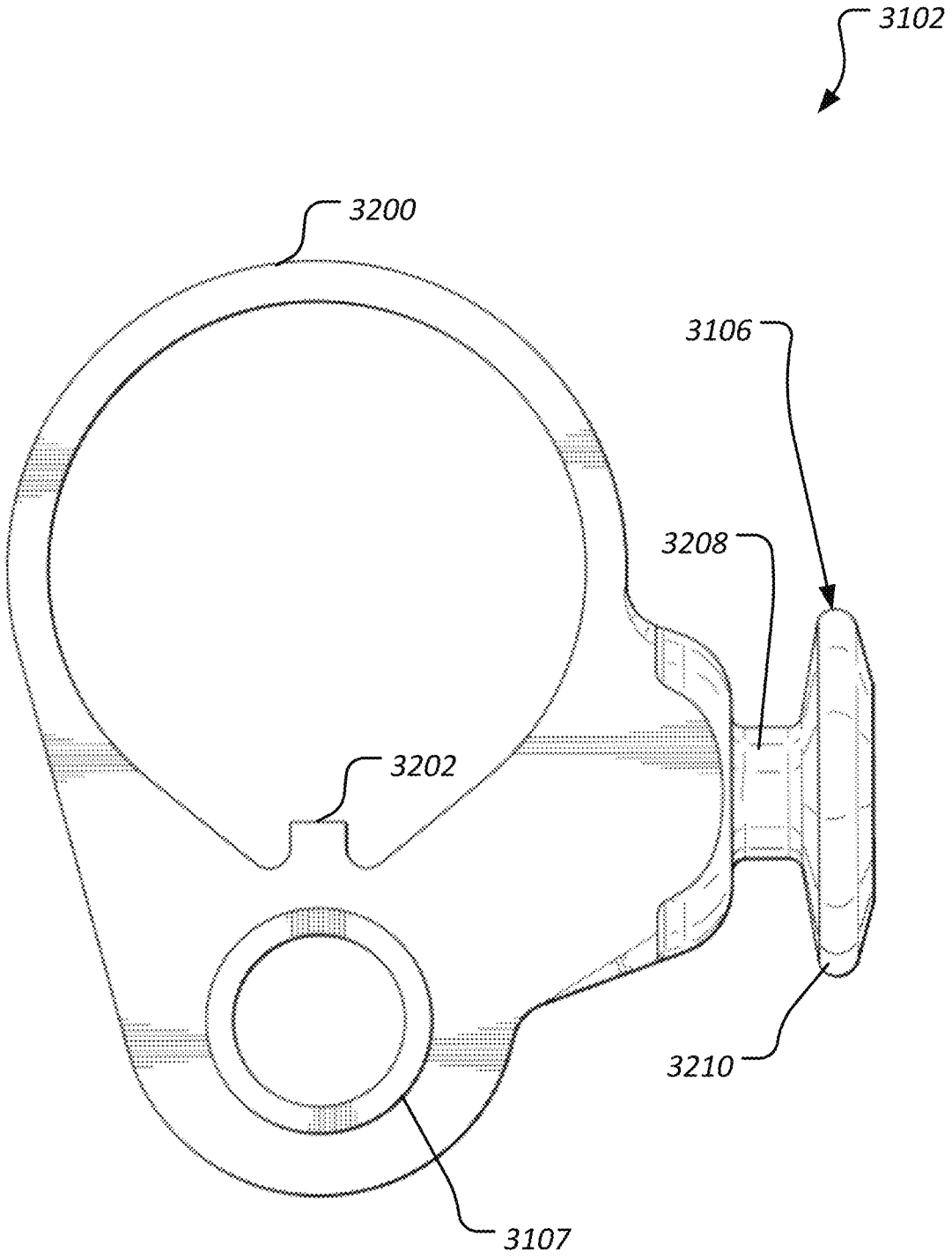
FIG. 9 is an orthogonal right view of the buffer tube mount of FIG. 1.
Figure 10:
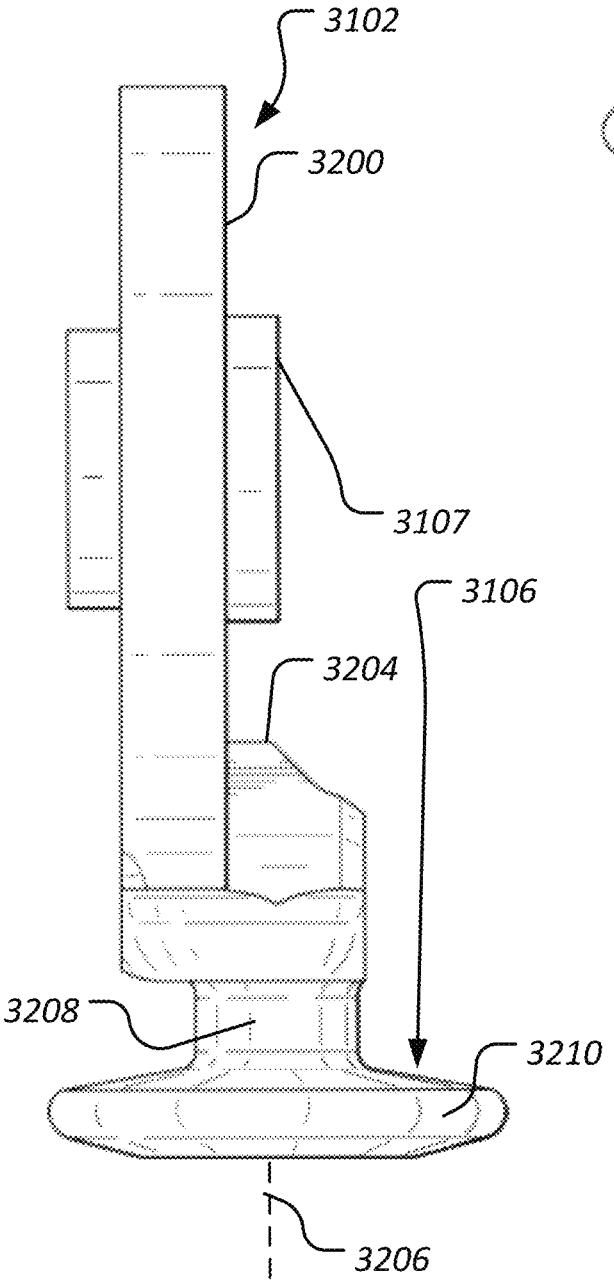
FIG. 10 is an orthogonal top view of the buffer tube mount of FIG. 1.
Figure 11:
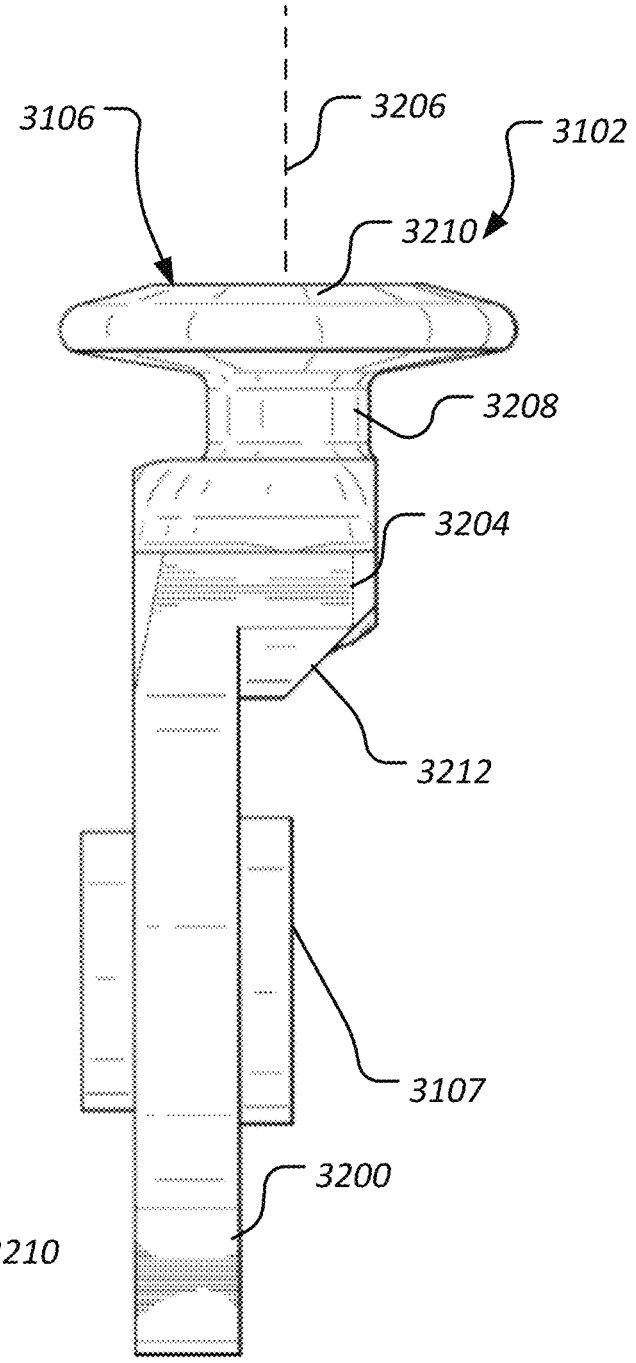
FIG. 11 is an orthogonal bottom view of the buffer tube mount of FIG. 1.
Figure 12:
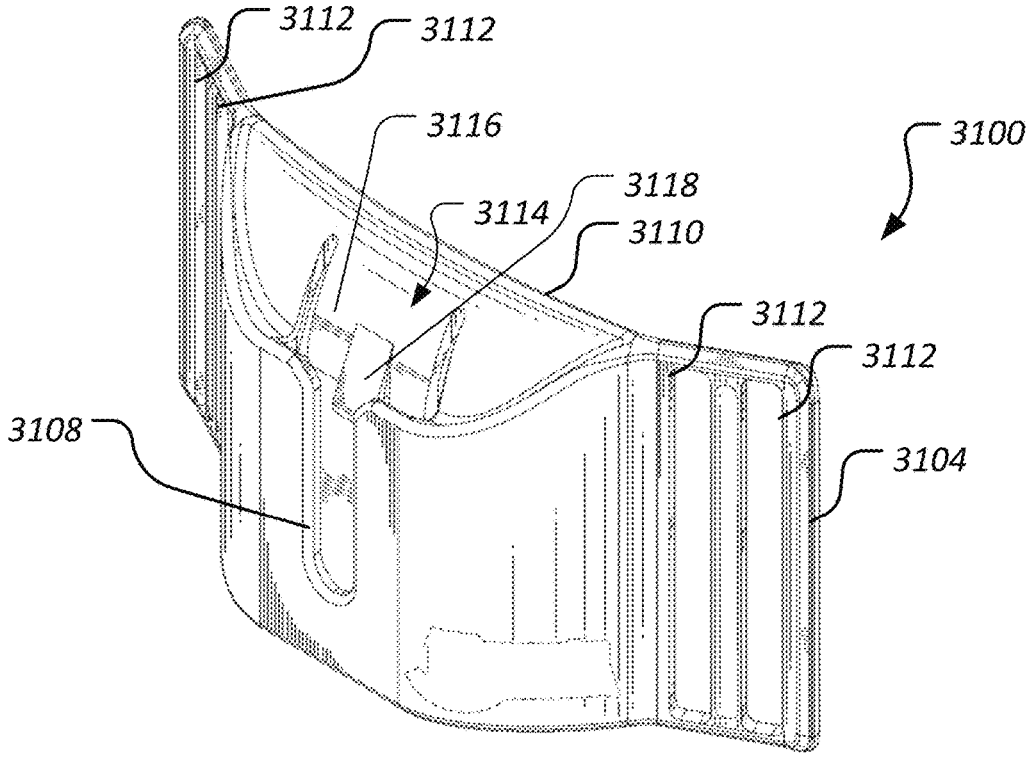
FIG. 12 is an oblique front right view of a receiver according to an embodiment of this disclosure.
Figure 13:
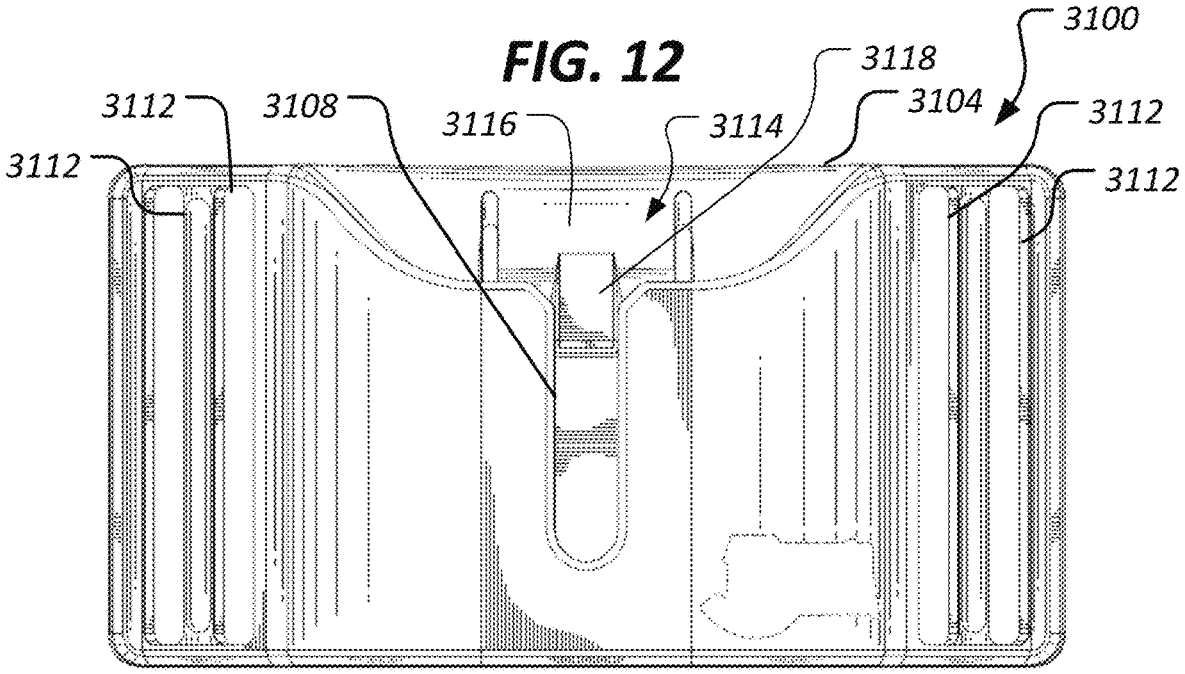
FIG. 13 is an orthogonal front view of the receiver of FIG. 1.
Figure 14:
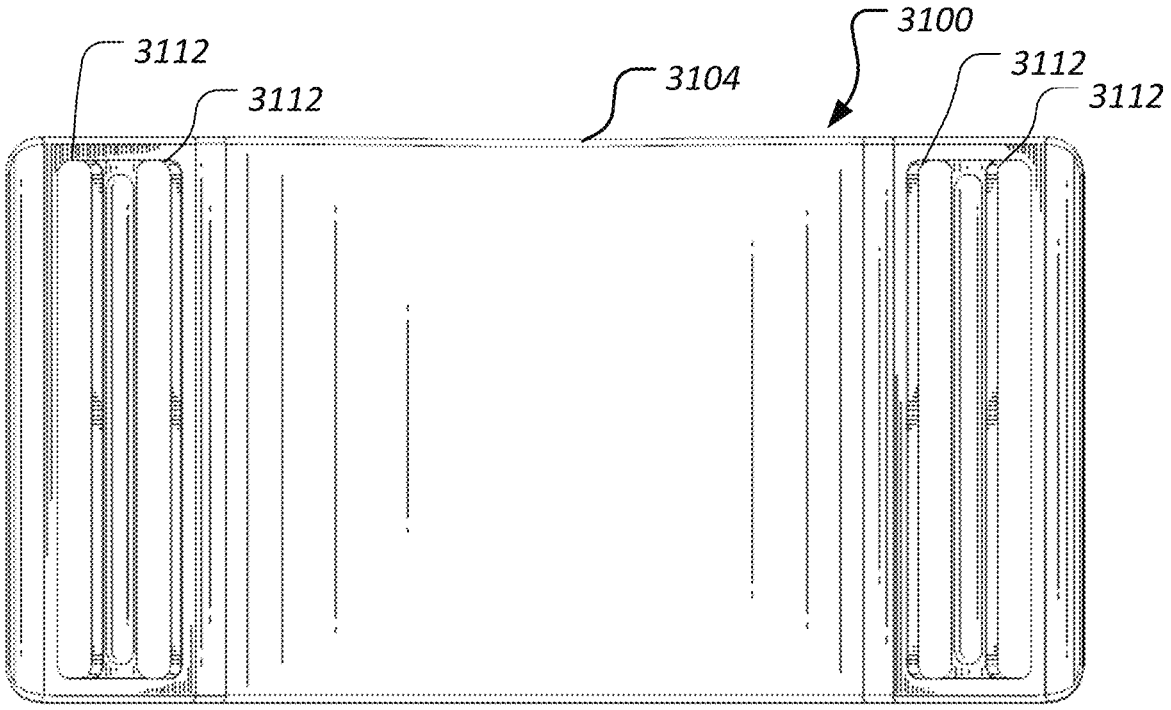
FIG. 14 is an orthogonal back view of the receiver of FIG. 1.
Figure 15:
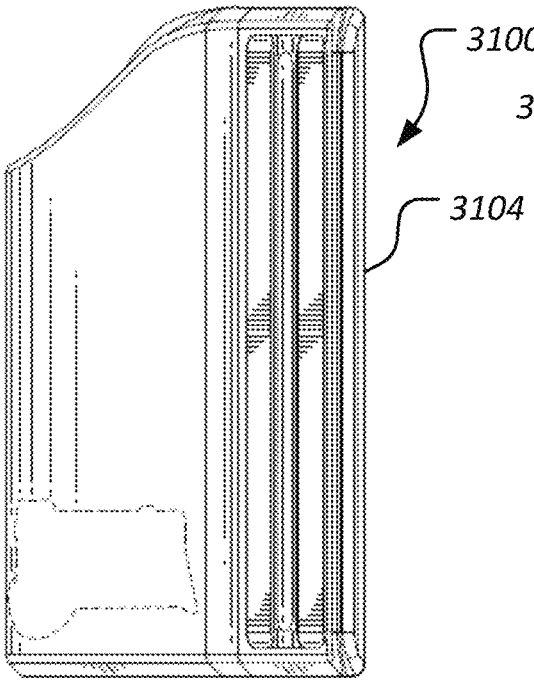
FIG. 15 is an orthogonal right view of the receiver of FIG. 1.
Figure 16:
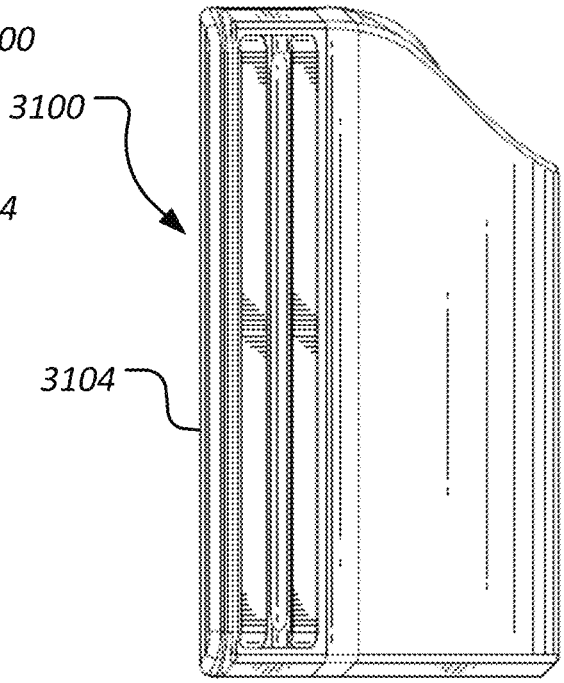
FIG. 16 is an orthogonal left view of the receiver of FIG. 1.
Figure 17:
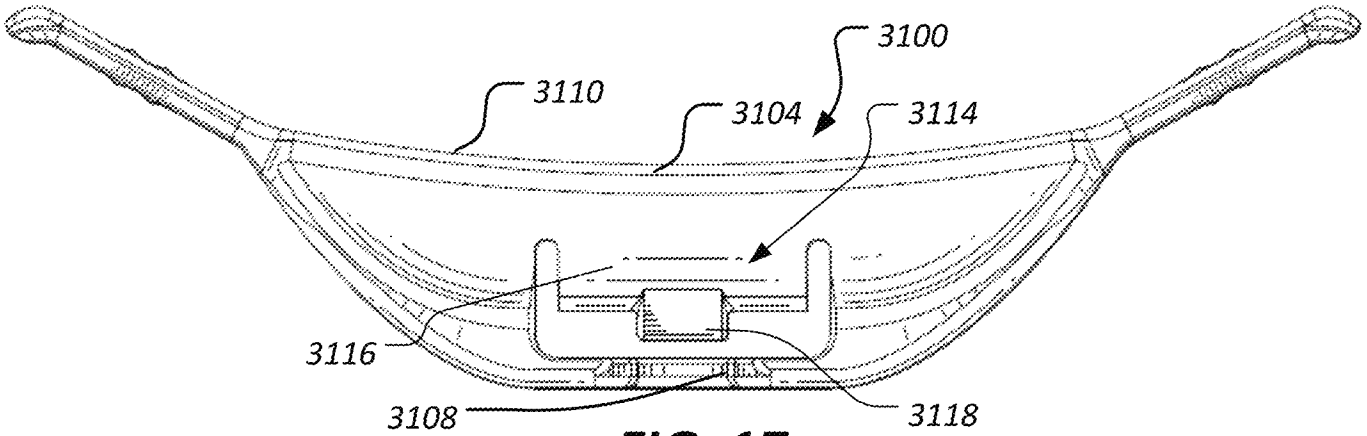
FIG. 17 is an orthogonal top view of the receiver of FIG. 1.
Figure 18:
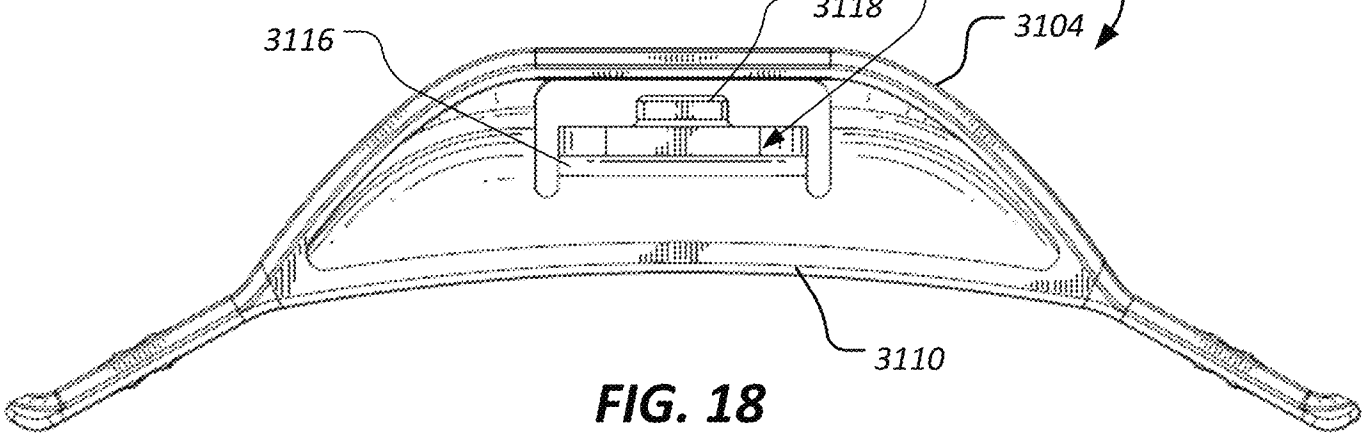
FIG. 18 is an orthogonal bottom view of the receiver of FIG. 1.

The BTM 3102 can be coaxially received on a buffer tube 3103 or other cylindrical firearm component and secured in place with a castle nut 3105 or other retention device. Most generally, the BTM 3102 can be installed and uninstalled from an AR-15 type firearm in substantially the same manner as commercially available receiver end plate and in a manner commonly known by those skilled in the art of assembly and/or disassembly of AR-15 type firearms. In some cases, the FSS 3100 can be used in conjunction with use of a shoulder strap and/or shoulder carrying sling by connecting a quick disconnect to the quick disconnect feature 3107 of the BTM 3102. The receiver 3104 may comprise plastic and/or any other suitable material, including, but not limited to, metal. A curvature 3110 in the receiver 3104 allows for a comfortable fit with openings 3112 on each end of the receiver 3104 for the belt to be run through and attached to a user on the hip and/or waist area. Alternative embodiments of the receiver 3104 can comprise different features for attachment to segmented straps (MOLLE straps). The second complementary component 3108 may comprise a long vertical area that allows the male part of first complementary component 3106 to slide into a channel of the second complementary component 3108 and be selectively held in place. In this embodiment, the receiver 3104 comprises a locking mechanism 3114 to keep the joinder between the first complementary component 3106 and the second complementary component 3108. The locking mechanism 3114 comprise a deflectable biased integral ramp 3116 that carries a catch 3118 that allows selective keeping of the joinder between the first complementary component 3106 and the second complementary component 3108. The receiver 3104 can be formed via a plastic injection mold. With sufficient introduction of the knuckle portion of the first complementary component 3106 into the channel of the second complementary component 3108, the BTM 3102 can be automatically captured by the receiver 3104. The BTM 3102 and the receiver 3104 can then be safely separated by simply pressing and deflecting the integral ramp 3116 toward the curvature 3110 until the catch 3118 no longer obstructs removal of the first complementary component 3106. With the integral ramp 3116 sufficiently deflected toward the curvature 3110, the first complementary component 3106 can be removed from the second complementary component 3108. FIG. 3 shows the first complementary component 3106 captured by the second complementary component 3108. FIG. 4 shows the first complementary component 3106 near engagement with the second complementary component 3108 but with the first complementary component 3106 not captured by the second complementary component 3108. FIGS. 3 and 4 also show the BTM 3102 in different orientations relative to the receiver 3104. In some embodiments, the BTM 3102 can rotate relative to the receiver 3104 even when the first complementary component 3106 is captured by the second complementary component 3108.

Referring more specifically to FIGS. 6-11, the BTM 3102 generally comprises a ring 3200 sized and configured to receive a buffer tube 3103 or other cylindrical component therethrough. The BTM 3102 may comprise a key 3202 for ensuring a selected angular orientation relative to the buffer tube 3103 or other cylindrical component that may comprise a complementary channel for receiving the key 3202. The BTM 3102 may further comprise a shelf 3204 that, when installed on an AR-15 type firearm, extends from the ring 3200 toward a rear of the firearm and/or toward the castle nut 3105. In some embodiments, the first complementary component 3106 comprises an axis 3206 extending from the shelf 3204 along which a neck 3208 and a head 3210 are substantially coaxially aligned. In some embodiments, the axis 3206 is laterally offset from the ring 3200. In some embodiments, the head 3210 outer diameter is greater than a lateral length of the ring 3200 (see FIGS. 10 and 11). In some embodiments, the head 3210 outer diameter is greater than a lateral length of the combined lateral length of the ring 3200 and the shelf 3204 (see FIGS. 10 and 11). In some embodiments, the shelf 3204 may comprise a ramp 3212 which allows additional clearance for quick disconnect devices that may be connected to the quick disconnect feature 3107.

It will be appreciated that while the BTM 3102 is shown in a right-handed configuration, alternative embodiments may comprise substantially the same features but in a mirror image so that a left-handed configuration can be obtained. Alternatively, one or more features of the BTM 3102 may be duplicated so that a single BTM provides both right-handed and left-handed compatibility. For example, an additional first complementary component 3106 may be provided to the BTM 3102. In operation, the FSS 3100 allows for comfortable and rotatable carriage of a firearm or other device to which a BTM 3102 can be mounted, with the weight of the firearm being transferred to, a support structure to which the receiver 3104 is attached, such as, but not limited to, a belt, vest, wall, post, and/or any other suitable structure for supporting the FSS 3100 and an associated firearm and/or device.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k * (R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A firearm support system (FSS), comprising:

a buffer tube mount (BTM) comprising a first complementary component; and a receiver comprising a second complementary component configured to selectively receive the first complementary component;

a neck that extends from a shelf; and a curved transition portion of the shelf connecting the shelf to the neck, wherein the curved transition portion comprises a profile configured to guide the first complementary component toward a most distal section of the neck without catching against the curved transition portion as the first complementary component is slid against the curved transition portion from the shelf to the most distal section of the neck;

wherein the BTM comprises a shelf that extends from a ring of the BTM; and wherein the first complementary component is connected to the ring via the shelf; and wherein the curved transition portion provides substantially the only decrease in radial extent present between the ring and the most distal section of the neck; and wherein the shelf is the only shelf disposed between the ring and the most distal section of the neck.

2. The FSS of claim 1, wherein at least a portion of the shelf extends laterally beyond a lateral extent of the ring.

3. The FSS of claim 2, wherein the shelf extends laterally beyond only one lateral extent of the ring.

4. The FSS of claim 1, wherein the first complementary component comprises an axis that is laterally offset from the ring.

5. The FSS of claim 4, wherein the first complementary component comprises a substantially disc-shaped head disposed coaxially with the axis.

6. The FSS of claim 5, wherein the head comprises an outer diameter greater than a lateral length of the ring.

7. A buffer tube mount (BTM), comprising:

a ring;

a shelf that extends laterally from the ring;

a neck extending from the shelf, the neck comprising a central longitudinal axis; and a curved transition portion of the shelf connecting the neck to the shelf, wherein the curved transition portion comprises a profile that only decreases in radial extent from the central longitudinal axis as measured along a longitudinal path from the shelf to a most distal section of the neck;

wherein the curved transition portion provides substantially the only decrease in radial extent present between the ring and the most distal section of the neck; and wherein the shelf is the only shelf disposed between the ring and the most distal section of the neck.

8. The BTM of claim 7, wherein the shelf extends laterally beyond only one lateral extent of the ring.

9. The BTM of claim 7, further comprising a substantially disc-shaped head disposed on a distal portion of the neck.

10. The BTM of claim 9, wherein the neck and the head are substantially coaxially aligned about an axis.

11. The BTM of claim 10, wherein the axis is laterally offset from the ring.

12. The BTM of claim 11, wherein the head comprises an outer diameter greater than a lateral length of the ring.

13. The BTM of claim 9, wherein the head comprises an inclined or curved connection to the neck.

* * * * *